US011266233B2

(12) United States Patent
LaDuke et al.

(10) Patent No.: US 11,266,233 B2
(45) Date of Patent: Mar. 8, 2022

(54) WIRE MANAGEMENT SYSTEM FOR OFFICE FURNITURE

(71) Applicants: Peter LaDuke, Holland, MI (US); Tod Babick, Grand Rapids, MI (US)

(72) Inventors: Peter LaDuke, Holland, MI (US); Tod Babick, Grand Rapids, MI (US)

( * ) Notice: Subject to any disclaimer, the term of this patent is extended or adjusted under 35 U.S.C. 154(b) by 0 days.

(21) Appl. No.: 16/860,356

(22) Filed: Apr. 28, 2020

(65) Prior Publication Data

US 2021/0330074 A1 Oct. 28, 2021

(51) Int. Cl.
*A47B 21/06* (2006.01)
*A47B 97/00* (2006.01)

(52) U.S. Cl.
CPC ..... *A47B 21/06* (2013.01); *A47B 2021/064* (2013.01); *A47B 2021/066* (2013.01); *A47B 2097/003* (2013.01)

(58) Field of Classification Search
CPC ..... A47B 21/06; A47B 2097/003
USPC ..... 248/188.8
See application file for complete search history.

(56) References Cited

U.S. PATENT DOCUMENTS 4,296,981 A * 10/1981 Hildebrandt ..... A47B 21/06 312/194
5,715,761 A * 2/1998 Frattini ..... A47B 7/02 108/50.02
5,971,509 A * 10/1999 Deimen ..... A47B 21/06 108/26
6,086,028 A * 7/2000 Pfister ..... A47B 21/06 108/50.01
6,293,506 B1 * 9/2001 Gutgsell ..... A47B 21/06 108/50.01
8,146,514 B2 * 4/2012 Hamilton ..... A47B 13/06 108/50.02
2002/0043183 A1 * 4/2002 Insalaco ..... A47B 21/06 108/50.02
2012/0103234 A1 * 5/2012 Schiavello ..... A47B 21/06 108/28
2012/0304900 A1 * 12/2012 Henriott ..... A47B 13/003 108/91
2014/0261094 A1 * 9/2014 Parshad ..... A47B 83/045 108/28
2015/0083870 A1 * 3/2015 Steelman ..... F16B 12/44 248/121
2017/0112275 A1 * 4/2017 Danville ..... A47B 21/03

* cited by examiner

*Primary Examiner* — Daniel J Rohrhoff
(74) *Attorney, Agent, or Firm* — Gutwein Law; Greg N. Geiser

(57) ABSTRACT

A wire management system for a table leg is provided in a cooperative assembly with a table leg having a specific shape to receive a channel member with a cavity to receive various cables and cords. The wire management system is configured to work in a cohesive assembly and in an aesthetically pleasing manner, wherein the wire management system for a table leg is provided in a specific angular shape for receipt on a cooperative angular shape of the table leg or supporting member. Accordingly, the table leg of the cooperative assembly is provided in a geometric convex kite shape when view in cross section, wherein the kite shape is a quadrilateral having contiguous sides comprising two pairs of equal length sides that are adjacent to each other.

16 Claims, 5 Drawing Sheets

WIRE MANAGEMENT SYSTEM FOR OFFICE FURNITURE

CROSS-REFERENCE TO RELATED APPLICATION

Not Applicable

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

This invention relates generally to modular table and desking systems. More specifically, the present invention is directed to modular table and desking systems, and in particular, a wire management system in cooperation with a vertical table leg of office furniture.

BACKGROUND

Tables and desking systems come in countless forms and are utilized by everyone for eating, meeting with others, working, studying and other activities. Tables and desking systems are typically designed as a work surface for the placement of a variety of electronic devices, such as, computers and their associated peripherals and components. Accordingly, a modern desk and table assembly will be required to accommodate various cables and cords utilized by these components and peripheral devices.

To address these challenges several additional products and devices have been recently developed to help a desk or table user in organizing these cables and cords. One solution is the use of a cable tie or cord wrap to generally secure the cables and cords into a single wrapped bundle. Sometimes these ties and wraps are integrated directly into the desk or table to relocate the bundle to an underside or backside of the table or desk and out of view. Still other times these desks or tables utilize a dedicated channel or compartment to organize and hide these cables and cords.

Although these solutions are helpful, manufacturers and consumers alike are both seeking improved methods and solutions for hiding these cables and cords. Accordingly, there exists a need within the marketplace for an improved solution to organize and hiding cables and cords. In particular, it is preferred that this solution is integrated with the aesthetics of the table or desk and provided in an assembly that is quickly able to be accessed. Additionally, it is preferred that this solution be applicable to cords moving in both a vertical direction and horizontal direction from a table or desktop to a floor or wall outlet.

BRIEF SUMMARY OF THE INVENTION

The present disclosure is most generally related to office furniture in the form of a desk and table assembly with a cord management system.

In another aspect this present disclosure is related to a cord management assembly that is integrated as channel member removably received on a table or desk leg.

The wire management system for a table leg is provided in a cooperative assembly with a table leg or table support or desk leg or desk support having a specific shape to receive a channel member with a cavity to receive various cables and cords. In the preferred assembly of the present disclosure, the channel member is magnetically received on the structural member, such as a table leg, in a cooperative assembly to be easily removed and replaced to organize and hide the various cable members.

The wire management system is configured to work in a cohesive assembly and in an aesthetically pleasing manner, wherein the wire management system for a table leg is provided in a specific angular shape for receipt on a cooperative angular shape of the table leg or supporting member. Accordingly, the table leg of the cooperative assembly is provided in a geometric convex kite shape when view in cross section, wherein the kite shape is a quadrilateral having contiguous sides comprising two pairs of equal length sides that are adjacent to each other, with a first pair of equal length sides having a first length and a second pair of equal length sides having a second length, with the first length being less than the second length. In this preferred shape, the first length of the first pair of equal sides are adjacent at a first angle with the first angle preferably being obtuse or at a minimum an angle measurement of ninety (90) degrees or greater. The second length of the second pair of sides are adjacent at a second angle with the second angle being acute, wherein the first angle and the second angle are directly opposed the kite shape ends to form the contiguous shape.

This table leg shape being selected to work in cooperation with the channel member, wherein the channel member is shaped and sized for receipt in a fitment with the table leg first pair of equal sides. The channel member shape being angular and selected to generally mimic the table leg shape second pair of equal sides and second angle, wherein this angular shape allows a substantially seamless fitment in a cohesive assembly. The channel member having an exterior surface and an interior surface. The interior surface defining an interior cavity configured to receive the cables or cords to be retained. The channel member having a first end and a second end, the distance between the channel member first end and the channel member second end defining a length of the channel member. This length can be adjusted by a user by cutting the channel member to the desired length, wherein the channel member is preferably constructed of an extruded plastic material capable of being cut.

The channel member interior surface including a pair of edges with each edge of the pair of edges on an opposed side of the interior surface and including a pair of grooves. Each groove of the pair of grooves configured for the receipt of a magnet. The magnet configured to secure the channel member to the table leg or supporting member. Each of the grooves positioned on the interior surface at an angle corresponding to the first angle of the first pair of equal sides. Accordingly, the magnets when placed within the grooves form a shape corresponding to the first angle of the first equal sides, wherein the magnets are received on each side of the first pair of equal sides. Accordingly, the kite shape of the table leg or support is utilized to allow for a secure attachment of the channel member and provides a cohesive assembly with an improved aesthetic appearance.

Preferably, the channel member is provided in an angular shape corresponding to the second pair of equal sides of the kite shape of the table leg or support member, wherein the attachment of the channel member to the first equal sides forms a substantially symmetrical leg member or support member when viewed in cross section.

In the preferred embodiment, the channel member is secured with four magnets placed within the grooves at the first end opposed edges and the second end opposed edges. Accordingly, the channel member is sufficiently secured to the table leg or supporting member to retaining and securing various cables and cords.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

BRIEF DESCRIPTION OF THE DRAWING(S)

In the drawings, which are not necessarily drawn to scale, the numerals may describe components in different views. The drawings illustrate, generally, by way of example, but not by way of limitation, various examples and embodiments discussed in the present document.

DETAILED DESCRIPTION OF THE INVENTION

Figure 1:
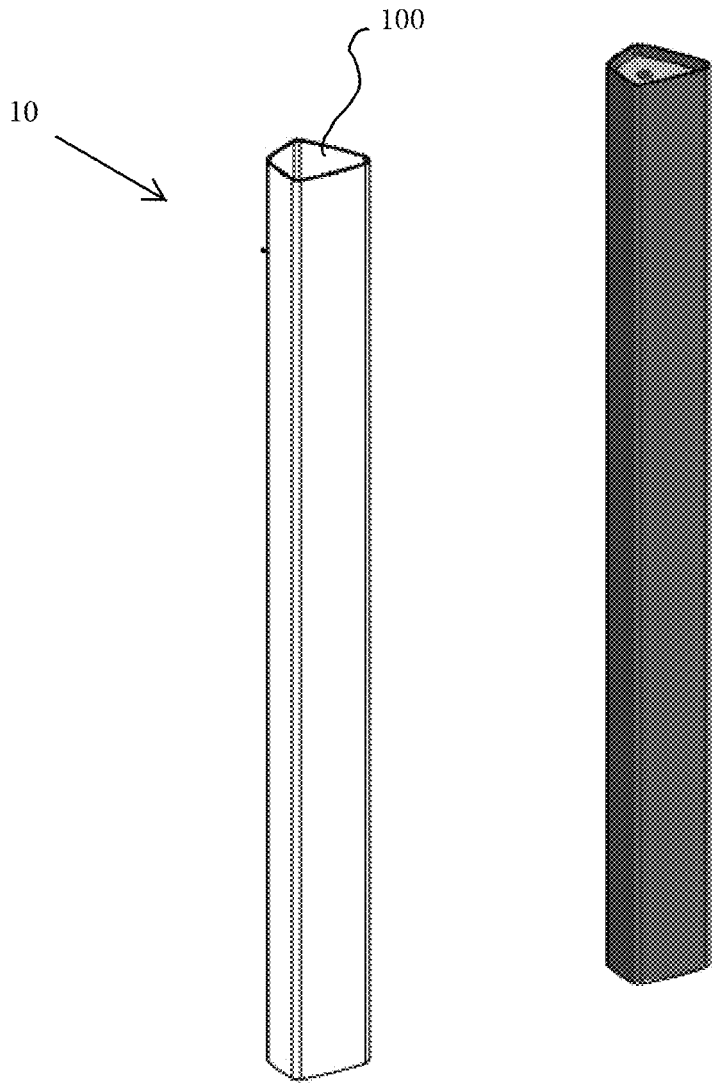
FIG. 1 is an isometric exploded view of a table leg, according to an example of the present invention.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative to the apparatus. These terms are not meant to limit the elements that they describe, as the various elements may be oriented differently in various applications.

As used herein, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

The present disclosure is most generally related to a desk and table assembly with a cord management system in the form of a channel member that is integrated as a removable member coupled in a cooperative and cohesive assembly with a correspondingly shaped table leg, desk leg, or supporting member.

Referring now to FIGS. 1-5, a table leg 10 and channel member 20 working in a cooperative assembly as a wire management system for a table leg are depicted in various views. Accordingly, the term table leg used throughout this specification is intended to refer to any supporting structure used as a support for a surface, whether positioned in a vertical or horizontal direction and including, but not limited to, a desk or a table. In the preferred assembly of the present disclosure, the channel member 20 is magnetically received on the table leg 10 in a cooperative assembly to be easily removed and replaced to organize and hide the various cable members.

Figure 2:
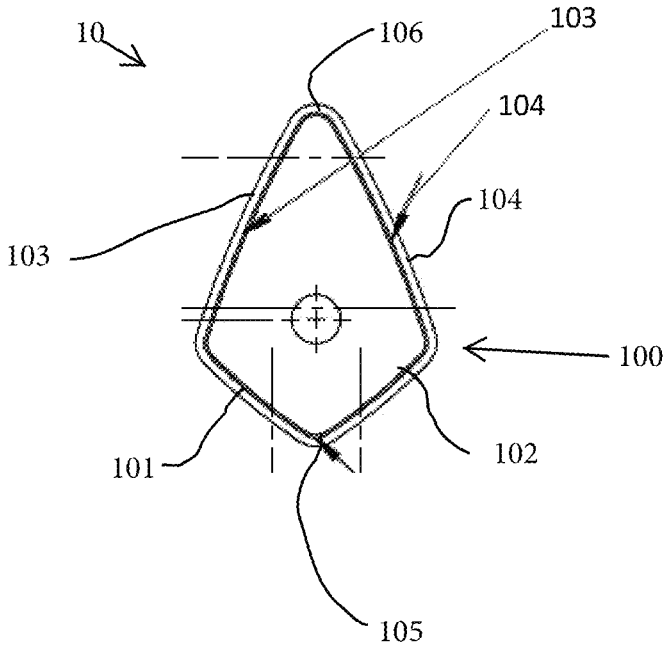
FIG. 2 is an end view of the table leg of FIG. 1, according to an example of the present invention.
Figure 3:
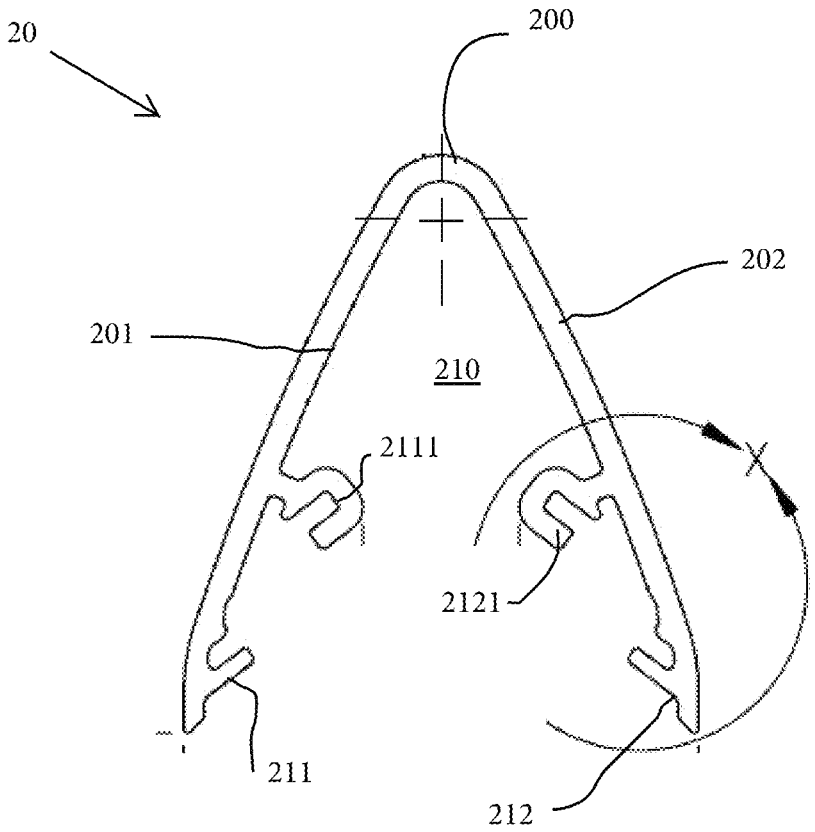
FIG. 3 is an end view of a channel member without magnets, according to an example of the present invention.
Figure 4:
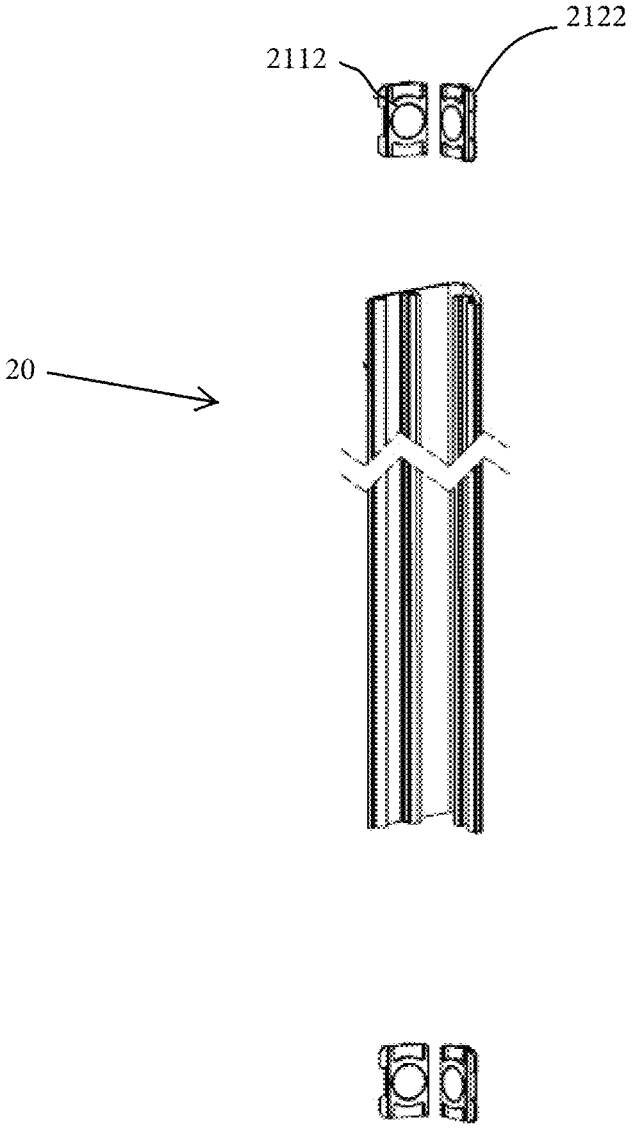
FIG. 4 is an isometric view of an interior surface of the channel member, according to an example of the present invention.
Figure 5:
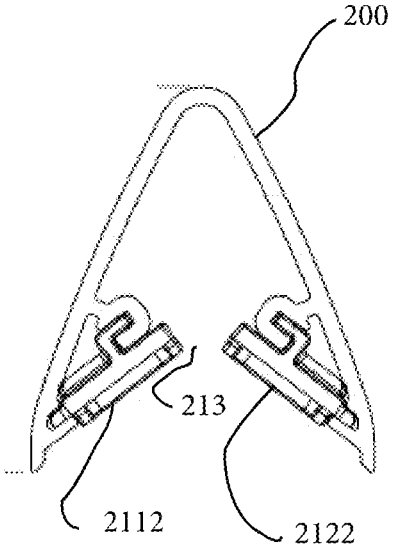
FIG. 5 is an end view of a channel member with magnets, according to an example of the present invention.

Referring now specifically to FIGS. 1-2, the table leg 10 is provided with a specific angular shape for receipt of the cooperative channel member 20. Accordingly, the table leg 10 of the cooperative assembly is provided in a geometric convex kite shape 100 when viewed in cross section. The kite shape 100 being a quadrilateral having contiguous sides comprising two pairs of equal length sides 101-102 and 103-104 that are adjacent to each other, with a first pair of equal length sides 101-102 having a first length and a second pair of equal length sides 103-104 having a second length, with the first length being less than the second length. In this preferred kite shape 100, the first length of the first pair of equal sides 101-102 are adjacent at a first angle 105 with the first angle 105 preferably being obtuse or at a minimum an angle having a measurement of ninety (90) degrees or greater. The second length of the second pair of equal sides 103-104 are adjacent at a second angle 106 with the second angle 106 being acute, wherein the first angle 105 and the second angle 106 are directly opposed at ends of the kite shape 100 to form the contiguous shape.

This table leg 10 kite shape 100 being selected to work in cooperation with the channel member 20, wherein the channel member 20 is shaped and sized for receipt in a fitment with the table leg 10 first pair of equal length sides 101-102. The channel member 20 shape 200 being angular and selected to generally mimic the table leg 10 second pair of equal length sides 103-104 and second angle 106, wherein the channel member 20 angular shape 200 allows a substantially seamless fitment in a cohesive assembly with the table leg 10. The channel member 20 having an exterior surface 202 and an interior surface 201. The interior surface 201 defining an interior cavity 210 configured to receive the cables or cords to be retained. The channel member 20 having a first end 203 and a second end 204, the distance between the channel member 20 first end 203 and the channel member 20 second end 204 defining a length of the channel member 20. This length can be adjusted by a user by cutting the channel member 20 to the desired length, wherein the channel member 20 is preferably constructed of an extruded plastic material capable of being cut to this desired length.

The channel member 20 interior surface 201 including a pair of edges 211, 212 with each edge 211, 212 of the pair of edges 211, 212 on an opposed side of the interior surface 210 and including a pair of grooves 2111, 2121. Each groove 2111, 2121 of the pair of grooves 2111, 2121 configured for the receipt of a magnet 2112, 2122. The magnets 2112, 2122 configured to secure the channel member 20 to the table leg 10 or supporting member. Each of the grooves 2111, 2121 positioned on the interior surface 201 at an angle 213 corresponding to the first angle 105 of the first pair of equal sides 101, 102. Accordingly, the magnets 2112, 2122 placed within the grooves 2111, 2121 form a shape corresponding to the first angle 105 of the first equal sides 101, 102, wherein the magnets 2112, 2122 are configured to be received on a respective side 101, 102 of the first pair of equal sides 101, 102. Accordingly, the convex kite shape 100 of the table leg 10 is utilized and selected to allow for a secure attachment of the channel member 20 and provides a cohesive assembly with an improved aesthetic appearance.

Preferably, the channel member 20 angular shape 200 corresponds to the second pair of equal sides 103, 104 of the kite shape 100 of the table leg 10 or support member, wherein the attachment of the channel member 20 to the first equal sides 101, 102 forms a substantially symmetrical assembly of the channel member 20 and table leg 10 member when viewed in cross section.

In the preferred embodiment, the channel member 20 is secured with four magnets 2112, 2122 placed within the grooves 2111, 2121 at the first end 203 opposed edges and the second end 204 opposed edges. Accordingly, the channel member 20 is sufficiently secured to the table leg 10 or supporting member to retaining and securing various cables and cords.

The inventors contemplate several alterations and improvements to the disclosed invention. Other alterations, variations, and combinations are possible that fall within the scope of the present invention. Although various embodiments of the present invention have been described, those skilled in the art will recognize more modifications that may be made that would nonetheless fall within the scope of the present invention. Therefore, the present invention should not be limited to the apparatus described. Instead, the scope of the present invention should be consistent with the invention claimed below.

What is claimed is:

1. A wire management assembly for a table, the wire management assembly comprising:

a table leg, the table leg having a kite shape when viewed in cross section, this kite shape comprising:

a first pair of equal length sides, each side of the first pair of equal length sides having a length;

a first angle between each side of the first pair of equal length sides;

a second pair of equal length sides, the second pair of equal length sides each having a length greater than the length of each side of the first pair of equal length sides; and a second angle between each side of the second pair of equal length sides; and a channel member, the channel member having an angular shape configured for a removable magnetic fitment to the first pair of equal length sides.

2. The wire management assembly of claim 1, wherein the first angle between each side of the first pair of equal length sides is ninety degrees or greater and the second angle between each side of the second pair of equal length sides is acute.

3. The wire management assembly of claim 1, wherein the first angle between each side of the first pair of equal length sides is obtuse and the second angle between each side of the second pair of equal length sides is acute.

4. The wire management assembly of claim 1, wherein the channel member includes a plurality of magnets, the magnets configured to magnetically adhere the channel member to the table leg.

5. The wire management assembly of claim 4, wherein the fitment of the channel member to the table leg forms a substantially symmetrical assembly when viewed in cross section.

6. A wire management assembly for a table, the wire management assembly comprising:

a table leg, the table leg having a kite shape when viewed in cross section, this kite shape comprising:

a first pair of equal length sides, each side of the first pair of equal length sides having a length;

a first angle between each side of the first pair of equal length sides;

a second pair of equal length sides, the second pair of equal length sides each having a length greater than the length of each side of the first pair of equal length sides; and a second angle between each side of the second pair of equal length sides; and a channel member, the channel member having an angular shape and comprising: an exterior surface; and an interior surface, the interior surface defining an interior cavity and having a pair of edges, the pair of edges configured for a removable magnetic fitment to the first pair of equal length sides.

7. The wire management assembly of claim 6, wherein the first angle between each side of the first pair of equal length sides is ninety degrees or greater and the second angle between each side of the second pair of equal length sides is acute.

8. The wire management assembly of claim 6, wherein the first angle between each side of the first pair of equal length sides is obtuse and the second angle between each side of the second pair of equal length sides is acute.

9. The wire management assembly of claim 6, wherein the channel member includes a plurality of magnets placed on the interior surface of each edge of the pair of edges, the magnets configured to removably adhere to the channel member to the table leg.

10. The wire management assembly of claim 9, wherein the fitment of the channel member to the table leg forms a substantially symmetrical assembly when viewed in cross section.

11. A wire management assembly for a table, the wire management assembly comprising:

a table leg, the table leg having a kite shape when viewed in cross section, this kite shape comprising:

a first pair of equal length sides, each side of the first pair of equal length sides having a length;

a first angle between each side of the first pair of equal length sides;

a second pair of equal length sides, the second pair of equal length sides each having a length greater than the length of each side of the first pair of equal length sides; and a second angle between each side of the second pair of equal length sides; and a channel member, the channel member having an angular shape and comprising: an exterior surface; and an interior surface, the interior surface defining an interior cavity and having a pair of edges with a pair of grooves positioned on the interior surface at an angle, the pair of edges configured for a removable fitment to the first pair of equal length sides.

12. The wire management assembly of claim 11, wherein the first angle between each side of the first pair of equal length sides is ninety degrees or greater and the second angle between each side of the second pair of equal length sides is acute.

13. The wire management assembly of claim 11, wherein the first angle between each side of the first pair of equal length sides is obtuse and the second angle between each side of the second pair of equal length sides is acute.

14. The wire management assembly of claim 11, wherein the channel member includes a plurality of magnets placed in the pair of grooves, the magnets configured to adhere to the channel member to the table leg.

15. The wire management assembly of claim 14, wherein an angle of the pair of grooves corresponds to the first angle.

16. The wire management assembly of claim 15, wherein the fitment of the channel member to the table leg forms a substantially symmetrical assembly when viewed in cross section.

* * * * *